United States Patent [19]

Hori et al.

[11] Patent Number: 4,745,246

[45] Date of Patent: May 17, 1988

[54] HIGH FREQUENCY HEATING APPARATUS WITH ELECTRIC HEATING DEVICE

[75] Inventors: Ichiroh Hori, Yamatokoriyama; Kazumi Hirai, Nabari; Mitsuo Akiyoshi, Nara; Yoshio Mitsumoto, Kashihara, all of Japan

[73] Assignee: Matsushita Electric Industrial Co., Ltd., Kadoma, Japan

[21] Appl. No.: 94,017

[22] Filed: Sep. 4, 1987

Related U.S. Application Data

[63] Continuation of Ser. No. 852,245, Apr. 15, 1986, abandoned.

[30] Foreign Application Priority Data

Apr. 15, 1985 [JP] Japan ..... 60-79614
Apr. 17, 1985 [JP] Japan ..... 60-81667
Jul. 9, 1985 [JP] Japan ..... 60-150768

[51] Int. Cl.[4] ..... H05B 6/64

[52] U.S. Cl. ..... 219/10.55 B; 219/10.55 F; 219/396; 219/407

[58] Field of Search ..... 219/10.55 B, 10.55 R, 219/10.55 E, 10.55 F, 392, 393, 395, 396, 397, 398, 403, 406, 407

[56] References Cited

U.S. PATENT DOCUMENTS

| | | | |
|---|---|---|---|
| 3,155,814 | 11/1964 | Appleman et al. | 219/407 |
| 3,626,135 | 12/1971 | Fitzmayer | 219/10.55 F |
| 3,878,350 | 4/1975 | Takagi | 219/10.55 E |
| 3,979,575 | 9/1976 | Maahs | 219/407 |
| 4,137,442 | 1/1979 | Tateda | 219/10.55 B |
| 4,196,330 | 4/1980 | Payne | 219/10.55 B |
| 4,308,444 | 12/1981 | Takagi et al. | 219/10.55 R X |
| 4,675,507 | 6/1987 | Akiyoshi et al. | 219/10.55 B |

*Primary Examiner*—Philip H. Leung
*Attorney, Agent, or Firm*—Wenderoth, Lind & Ponack

[57] ABSTRACT

A high frequency heating apparatus wherein oven heating and grill heating are performed by means of a flat heating element, and no heater and projections such as an insulator for holding a heater are provided, whereby, when high frequency microwave energy is supplied to the heating chamber with an oven plate placed in the heating chamber, abnormal heating such as local heating and sparks do not occur. Also, with the oven plate placed in the heating chamber, heating can be performed by means of high frequency microwaves and a heater which can be used alternately or in combination depending on situations to obtain the most preferably heating condition.

9 Claims, 6 Drawing Sheets

| | | | |
|---|---|---|---|
| conventional a | heater heating witho t preheating | Ta | X~△ |
| conventional b | heater heating with preheating (T1) | Tb | △ |
| c | plan-heater heating in close position to materials to be heated. | Tc | △~○ |
| d | high-frequency heating and plan-heater heating in close relation to materials to be heated. | Td | ○ |
| | heating system | heating time | cooking condition |

HIGH FREQUENCY HEATING APPARATUS WITH ELECTRIC HEATING DEVICE

This application is a continuation, of now abandoned application Ser. No. 852,245, filed Apr. 15, 1986.

BACKGROUND OF THE INVENTION

The invention relates to a high frequency heating apparatus with an electric heating device for the improvement of a method of heating and a construction for heating food material effectively and uniformly.

Generally, a high frequency heating apparatus with an electric heating device adopts two methods for heating food material, i.e., one method is to put food material in a heating chamber and heat it inwardly by heat energy generated from an electric heating device provided near the ceiling and the bottom of the chamber, and the other method is to directly irradiate food material in the heating chamber by high frequency waves supplied into the heating chamber so that food material generates heat outwardly. A selection as to which method to use is made depending on the type of food material and the cooking menu. Constructions of such conventional heating apparatuses are shown in FIGS. 1 to 5.

FIG. 1 is a cross-sectional view of a conventional high frequency heating apparatus with an electric heater, comprising a main body 1 provided with a heating chamber 2 which accommodates food material. Provided with heating chamber 2 are a food material supporting plate 3, a turn table 4 for preventing non-uniform heating of food material, an oven heater 5*a* and an oven and grill heater 5*b*, respectively disposed at the bottom and the ceiling of heating chamber 2 for heating food material by raising the temperature of heating chamber 2 and for performing oven and grill heating by means of radiant energy. Also provided in heating chamber 2 are high frequency oscillation devices, such as a magnetron 6 and a high voltage transformer 7. High frequency microwave energy is introduced into the heating chamber 2 through a supply opening portion 9 for supplying high frequency microwave energy provided at a portion in heating chamber 2, and conducted thereto by waveguide 8. The methods for heating food material by means of a high frequency heating apparatus with a heating device include a method using only high frequency microwaves, a method using high frequency microwaves and heaters 5*a* and 5*b* alternately, and a method using only heaters 5*a* and 5*b*. Thus, a preferable heating condition is obtained by selecting a heating method suitable for the particular food material and a cooking menu. When the food material is heated only by heaters 5*a* and 5*b*, as shown in FIG. 2, food material placed on a oven plate 10 can also be heated with the oven plate 10 made of metal and held approximately at the middle portion of heating chamber 2 by rails 11 mounted the sidewalls of heating chamber 2. Several rails 11 for holding the oven plate are longitudinally positioned stepwise along the sidewalls of heating chamber 2 to make it possible to shift the position of oven plate 10 so that food material can be heated most preferably depending on its size and the heating method employed. The output from heaters 5*a* and 5*b* can be adjusted to obtain a preferable heating condition in this heating apparatus.

In the case of oven and grill heating using heaters 5*a* and 5*b*, heating is performed after the atmosphere temperature in heating chamber 2 has been raised. Therefore, preheating must be performed in heating chamber 2, and the bulk temperature of food material is raised by high frequency microwaves with the material placed on the plate 3 and, thereafter, the material is placed on the oven plate 10 to heat it by heaters 5*a* and 5*b* in order to obtain a preferable condition by raising the temperature of heating chamber 2 and of the material. Thus, the heating operation according to this method, is very troublesome. Further more, a long time period is required to heat the material using only heaters, thus wasting energy. As is apparent, according to this method, the essential characteristics of a high frequency heating microwave apparatus cannot be attained, i.e., the heating operation is not easy, and high speed heating and energy saving cannot be accomplished. Heating of food material can be performed with the material placed on the plate 3 after heating by high frequency microwaves, but the advantage obtained by this method only saves the labor of shifting the material from the plate 3 to the oven plate 10. Further more, the time required for heating the material by this method is not so different from the time required when material heating is performed using only heaters 5*a* and 5*b*, and the amount of the material which can be cooked by one heating in this method is about 50% less than the amount possible when heating is performed using only heaters. For example, heating gratin for four men by this method must be performed twice. More specifically, the heating chamber 2 is usually rectangular in plan view, and the oven plate 10 is almost as large as heating chamber 2 so that heating chamber 2 is effectively used. However, the plate 3 is round in plan view and must be rotated to prevent high frequency microwaves from non-uniformly heating the material, and, thus, the quantity of material which absorbs heat considerably decrease. As shown in FIG. 3, it is supposed that easy operation, quick heating, and energy-savings can be accomplished when heating is performed by using a method of irradiating high frequency microwaves on the material with the oven plate 10 placed in the heating chamber 2 and thereafter, heating the material by heaters 5*a* and 5*b*. But, in practice, the heating chamber 2 is partitioned by the oven plate 10, so that the heating chamber 2 is small compared with the quantity of high frequency microwaves produced by the magnetron, and the electric field becomes very turbulent, which could cause, during high frequency microwave material heating, the material to be non-uniformly heated, abnormal heating in the heater 5*b* and insulator 12, sparks in the heater 5*b* because the electric field converges on projections such as the heater 5*b* and insulator 12 which holds heater 5*b*, during high frequency microwave heating, and increased electric wave leakage generated by the heater 5*b* in heating chamber 2. Thus, heating according to this method is very dangerous. Food material heating by the heaters is also disadvantageous because the material is non-uniformly heated when the heater 5*b* is positioned too close to the material, thus preventing fast heating. Therefore, safe, easy, fast, and energy efficient heating is very difficult to accomplish. This is particularly true for a grill heater.

In grill heater using radiant heat generated by heater 5*b*, there are two methods of heating food material depending on the material; on method is to heat the material by means of only heater 5*b* provided close to a ceiling, and the other one is where heater 5*b* is mainly auxiliary driven by heater 5*a* to raise the bulk temperature of the material so that a preferable heating condition can be obtained. But, in this method, of course, the material is mainly heated by heater 5b. In this method, when the quantity of food material and generated heat are constant, heating time periods and energy quantity required for heating the material are determined by the distance between the heater 5b and food material, the cubic measurement of the heating chamber partitioned by material placing plate 10 held by the sidewalls of heating chamber, the difference of radiant energy when a certain quantity of heat is generated by heater 5b, and a means for preventing heat energy from escaping from heating chamber 2. The time period required for heating is also important to obtain a preferable heating condition especially when grill heating is performed, so that the smaller a heating space is, and the higher heat temperature generated by heater 5b is, and the larger temperature retaining efficiency of the heating space is, the more effectively and uniformly food material is heated. Therefore, the position of rails 11 for holding material supporting plate 10, the insulation material 13 provided at the outside of heating chamber ceiling, and the to which the space is raised by heater 5b are commonly designed to obtain a speedy, energy efficient, and preferable heating condition.

A conventional heater 5b generally employs a sheathed heater whose configuration is shown in FIG. 4. As seen from the drawing, this configuration aims mainly at preventing various food materials from non-uniformly heating during oven heating. When heating is performed by placing food material adjacently to heater 5b to carry out fast, energy efficient heating, the material is scorched, as shown with scorch shading 14, in a short period of time at the portion close to the sheathed heater, and the material is not heated enough at the portion distant from the sheathed heater. Accordingly, when a sheathed heater 5b is placed close to the material, the material is very non-uniformly heated. When the material is placed distant from heater 5b to reduce the possibility of non-uniform heating of the material, radiant heat energy quantity per unit area is reduced, and the heating space is increased to a great extent. Consequently, fast, energy efficient heating cannot be accomplished, and in addition, heating is performed at low temperatures and the time period necessary for the heating is long. This is disadvantageous because grill heating must be performed after quickly raising the temperature of food material, resulting in that the surface of the material (food) becomes dry.

When food material is heated by high frequency microwaves, as shown in FIG. 1, the heating is performed with turn table 4, on which the material is placed and rotating to reduce the possibility of non-uniform heating of the material.

Likewise, when food material is heated by an electric heater, as shown in FIG. 2, heating is performed with the material placed on the oven plate 10 which is placed on rail 11 mounted on the sidewalls of heating chamber 2. At this time, heating is performed by two heaters 5a and 5b mounted on the bottom and the ceiling of heating chamber 2 to heat the material from the top and bottom thereof. Heaters 5a and 5b mounted on the bottom of heating chamber 2, are round, thereby causing the problem that heat generated by the heater 5a is collected under the turn table 4 and leads to the reduction of heat efficiency.

But this method has a disadvantage because the degree of heating of the center bottom portion of the material is much smaller than the other portions, causing non-uniform heating because convection currents and radiant heat generated by heater 5a flow only around the periphery of turn table 4.

SUMMARY OF THE INVENTION

In order to solve the problems described above, an essential object of the invention is to provide a high frequency microwave heating apparatus with a heater wherein, in spite of its simple construction, the heating operation is easy, and efficient heating, i.e., quick energy-efficient heating, can be safely performed.

According to the invention, the high frequency microwave heating apparatus with a heater of the invention comprises a heating chamber for accommodating food material, a high frequency oscillation device for supplying microwave energy at high frequencies to said heating chamber, a flat heating element provided in at least an upper portion of the heating chamber for raising the atmosphere temperature of the heating chamber, an oven plate holding means mounted on the heating chamber sidewalls, an electric supply opening for supplying high frequency microwaves to the heating chamber provided at a portion of the heating chamber sidewall disposed between said flat heating element and said holding means, and a bulge portion provided on the heating chamber sidewalls opposed to said electric supply opening in such a direction as to enlarge the heating chamber. The apparatus having the heating chamber for accommodating food material further comprises, a pair of heating elements for raising the atmosphere temperature of the heating chamber provided at the ceiling and the bottom portion of the heating chamber, a detachably mounted food material supporting plate, food material supporting plate holding means provided on the heating chamber sidewalls, wherein the heating element provided at the ceiling of the heating chamber is flat and is mainly driven when the food material supporting plate is placed in the heating chamber, the food material supporting plate being composed of a material having a preferable heat reflection rate or a surface-treated material or a material having a preferable heat reflection rate, and a metal turn table having numerous perforations formed so as to prevent high frequency electric power from passing therethrough. Also, the entire surface of each wall of the heating chamber above the food material supporting plate placed in the heating chamber is insulated and the bottom portion of the heating chamber is provided with a heating device having an area that covers the entire area of the bottom portion of the heating chamber. According to the construction described above, when high frequency microwave energy is supplied to the heating chamber, with an oven plate placed in its center, neither local abnormal heating and sparks, nor electric wave leakage occurs and fast energy-efficient heating can be easily performed because of the provision of the flat heating element provided at the upper portion of the heating chamber and microwave supply opening, for supplying high frequency microwaves to the heating chamber, disposed in a heating chamber sidewall between the flat heating element disposed at the position where high frequency microwaves can be irradiated and the oven plate holding means placed in the heating chamber. In addition, in order to effect very uniform heating of material and to further impede high frequency microwave irregularities caused by a drastic impedance change depending on loads imparted to the magnetron when the oven plate is placed in the heating chamber, a bulge portion is provided in a heating chamber wall opposite to the high frequency microwave supply opening in such a direction as to enlarge the heating chamber, thereby to prevent non-uniform heating and mismatched impedance. Thus, when the oven plate is placed in the heating chamber, effective heating can be accomplished.

When heating of food material (food) is performed by the grill heating method, i.e., mainly by means of a heating element provided at the heating chamber ceiling, the provision of a flat heating element is effective for uniformly heating food material when the material is placed close to the flat heating element. By making the heating space as small as possible by properly placing the food material supporting plate in the heating chamber, the temperature in the heating chamber rises rapidly; hence, effective heating, i.e., fast, energy-efficient heating can be performed. In order to greatly improve heat efficiency of the flat heating element, the apparatus is provided with a material supporting plate which has a preferable heat reflection rate or which is treated on its surface to have an excellent heat reflection rate and disposed between food material and the material supporting plate. Thus, radiant energy, generated by the flat heating element, which has not irradiated the material and has been absorbed by the material supporting plate is reflected by the plate to the heating space located above and the flat heating element also located above. As a result, the temperature of the flat heating element rises, thereby greatly improving heat efficiency. Furthermore, the provision of insulation applied to the entire surface of each heating chamber wall disposed above the food material supporting plate permits the temperature in the heating space to raise to a very high level when heating is accomplished by the grill heating method which requires temperatures higher than those required in an oven heating method.

Further, since the heater is mounted to cover the entire bottom of the heating chamber and the turn table has numerous perforations, heat generated by the heater is conducted uniformly upward and flatly on food material, with the result that the material is uniformly heated. When heating is performed by high frequency microwaves, the turn table prevents non-uniform heating when it rotates. Further, the perforations on the turn table do not intensely heat food material because the diameters of the perforations are so formed to prevent the passage of high frequency electric waves.

BRIEF DESCRIPTION OF THE DRAWINGS

These and other objects and features of the present invention will become apparent from the following description of a preferred embodiment thereof taken in conjunction with the accompanying drawings, in which.

DETAILED DESCRIPTION OF THE EMBODIMENTS

Figure 1:
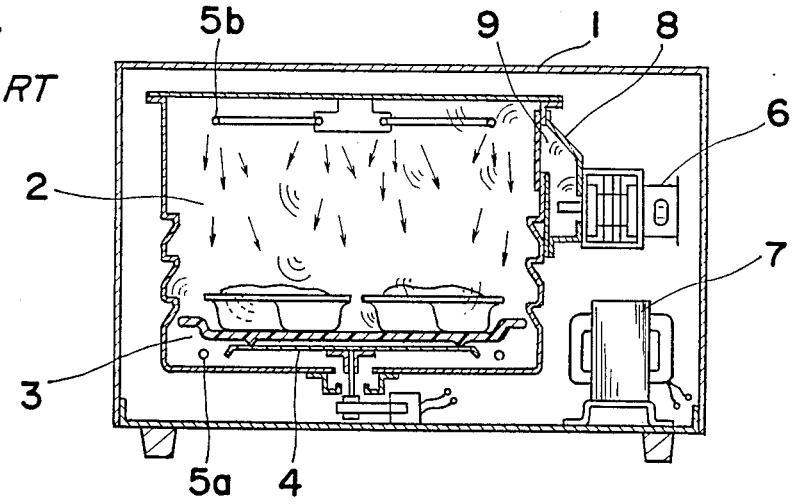
Fig. 1 PRIOR ART
FIG. 1 is a cross-sectional view of a conventional high frequency heating apparatus with a heater, as already described above.
Figure 2:
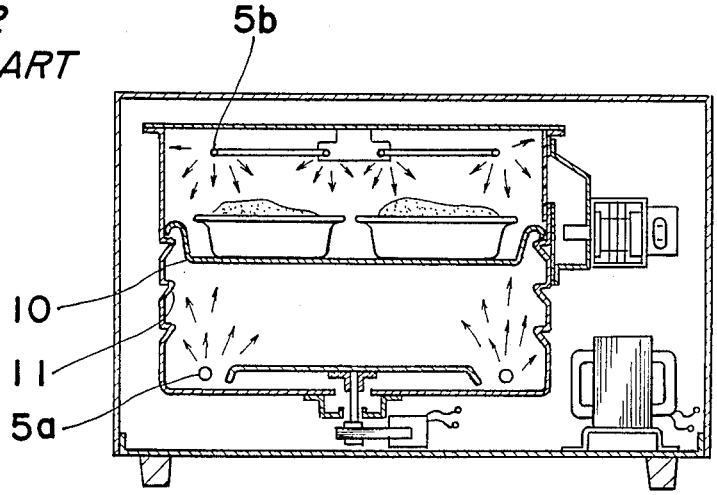
Fig. 2 PRIOR ART
FIG. 2 is a similar view of the apparatus during oven heating.
Figure 3:
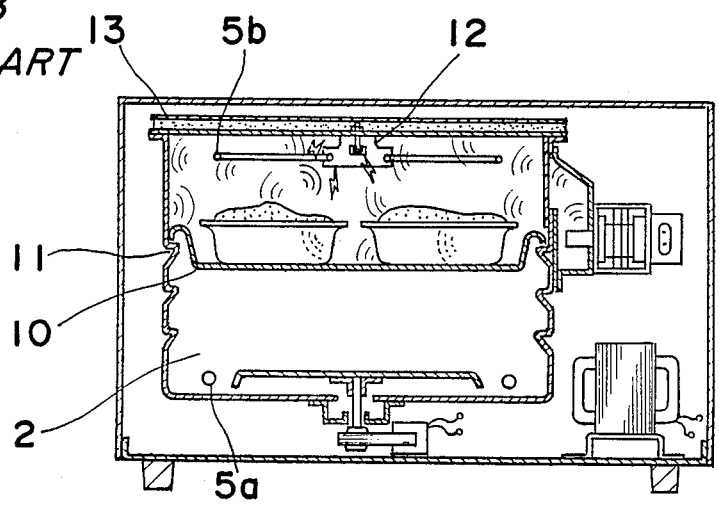
Fig. 3 PRIOR ART
FIG. 3 is a similar view of the apparatus in which oven heating is performed by high frequency microwaves.
Figure 4:
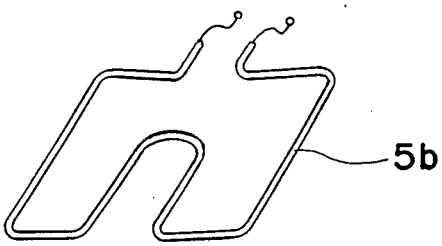
Fig. 4 (a) PRIOR ART
FIGS. 4*a* and 4*b* are perspective views showing the heating condition of food material and a heater in a conventional high frequency heating apparatus with a heater when grill heating is performed with food material placed adjacently to the heater.
Figure 4B:
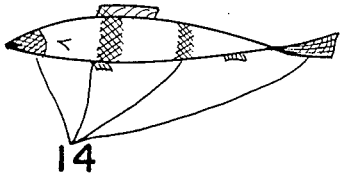
Fig. 4(b) PRIOR ART
Figure 5:
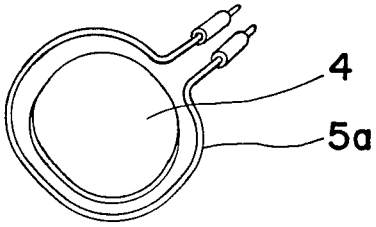
Fig. 5 PRIOR ART
FIG. 5 is a perspective view showing a turn table to be provided in a conventional high frequency heating apparatus with a heater provided adjacently to the bottom of a heating chamber.
Figure 6:
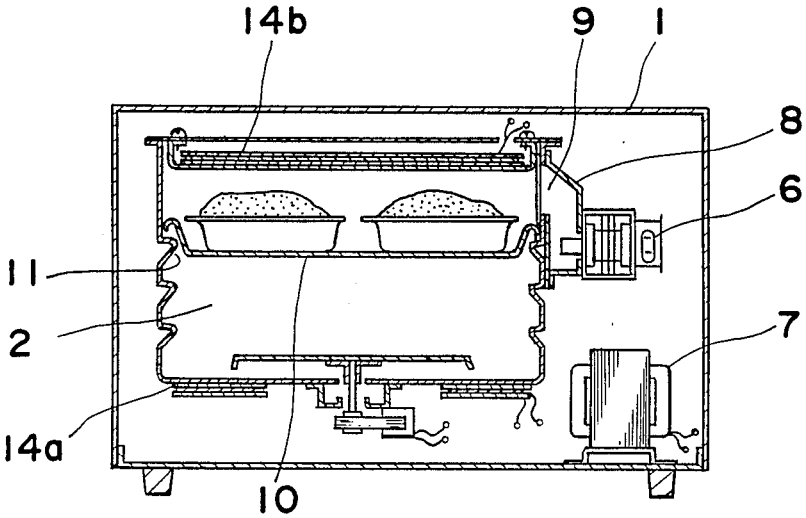
FIG. 6 is a cross-sectional view of a high frequency heating apparatus with an electric heating device in accordance with a first embodiment of the invention.

Before the description of the present invention proceeds, it is to be noted that like parts are designated by like reference numerals throughout the accompanying drawings.

Figure 7:
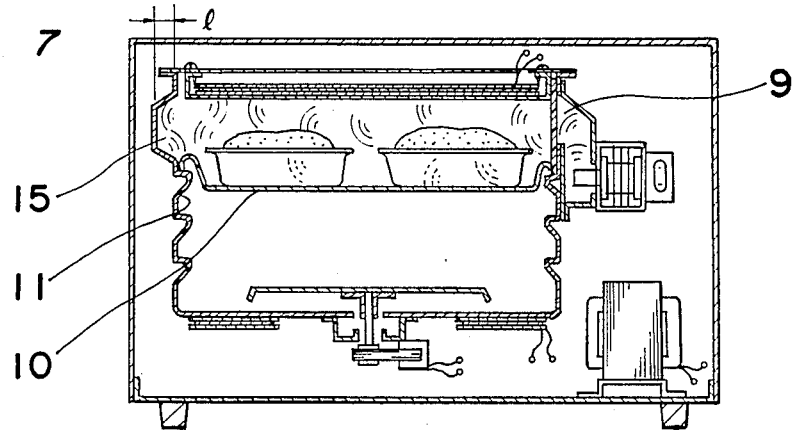
FIGS. 7 through 9 are cross-sectional views of a high frequency heating apparatus with an electric heating device in accordance with a second embodiment of the invention.
Figure 8:
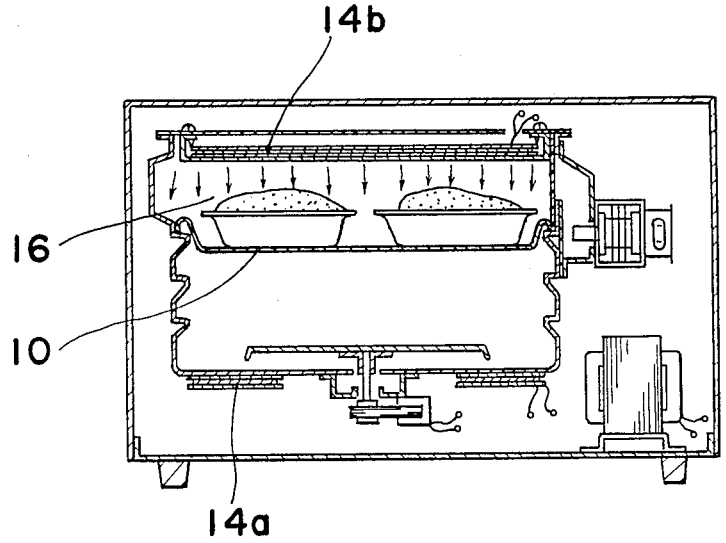

The first embodiment of the invention will be described with reference to the accompanying drawings of FIGS. 6 through 14. In FIGS. 6 through 14, a main body 1 of a high frequency heating apparatus with a heating device is provided with a heating chamber 2 for accommodating food material therein. The heating chamber 2 is provided therein with a pair of flat heating elements 14*a* and 14*b* at the bottom and ceiling thereof. Main body 1 is provided with a magnetron 6 for generating electric waves of high frequency and a high voltage transformer 7 for oscillating at high frequency. The high frequency microwaves generated by these devices 6 and 7 and conducted through waveguide 8 is introduced into heating chamber 2 through a high frequency microwave supply opening 9 provided at a portion of the sidewall of heating chamber 2, positioned between a flat heating element 14*b* mounted on the upper portion of heating chamber 2 and a rail 11 provided on the sidewall of heating chamber 2 for serving as a means to hold an oven plate 10. As shown in FIG. 7, above the oven plate 10 placed on the rail 11 in heating chamber 2, there is provided a bulge portion 15 in the sidewall of the heating chamber 2 opposite to high frequency supply opening 9 and extending in such a direction as to enlarge the heating chamber 2. The bulge portion 15 is provided to eliminate non-uniform heating of food material and to improve irregularities of high frequency caused by drastic changes of impedance the on load imparted to magnetron 6. With this arrangement, the high frequency microwaves to be supplied into the heating chamber 2, with the oven plate 10 on the rail 11 of heating chamber 2, never causes heating abnormalities and sparks which may occur in a conventional high frequency supply oscillation apparatus because of the convergence of electric field at projections such as a heater and an insulation, and electric wave leakage generated by the heater 5*b* from the heating chamber 2 of FIG. 1. Further, effective high frequency heating can be accomplished within the heating chamber 2 because preferable distribution characteristics and matching high frequencies are performed by the provision of bulge portion 15, with oven plate 10 placed in heating chamber 2. In addition, as shown in FIG. 8, fast energy-efficient heating is easily obtained because grill heating is performed by a flat heating element 14*b* after raising the bulk temperature of food material by means of effective high frequency heating. At this time, the food material is uniformly heated because the flat heating element 14*b* generates heat over the entire surface of the food material. Therefore, food material can be preferably placed adjacent to flat heating element 14*b*. Because of a reduced heating space 16, heating energy is not wasted and high temperatures can be very quickly obtained in heating space 16. According to the apparatus of the invention, the disadvantages of a conventional high frequency heating apparatus that include the lack of a preferable heating condition because of the long heating time period can be eliminated.

Figure 9:
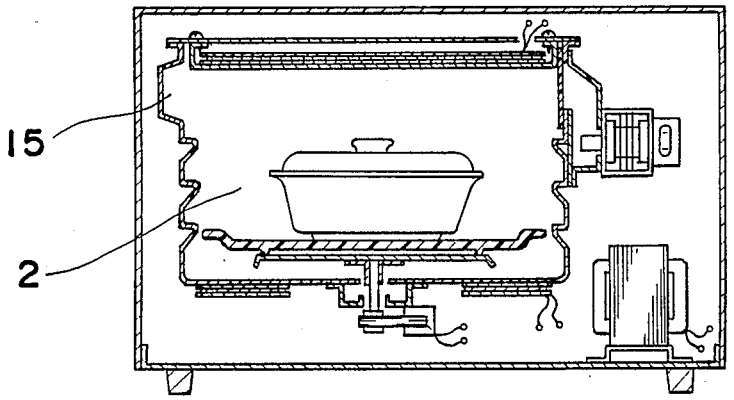

The bulge portion 15, shown in FIG. 9, serves as a means for improving non-uniform heating of the food material and non-preferable impedance matching which occur in the heating chamber 2 when heating is performed only by high frequency microwaves with the oven plate 10 placed in heating chamber 2. But, as seen from FIG. 9, the bulge portion 15 does not influence the high frequency response characteristic in view of the cubic measurement of bulge portion 15 in comparison with that of heating chamber 2 when the oven plate 10 is not put in heating chamber 2. But when the oven plate 10 is placed in heating chamber 2, the bulge portion 15 greatly influences the high frequency response characteristic, i.e., the high frequency response characteristic of heating chamber 2 can be improved to a preferable extent by varying the depth (l) of bulge portion 15. According to this construction, a similar advantage can be also obtained in a heating oven which is performed by raising the atmosphere temperature of heating chamber 2, and also in heating using a heater. The operation of the high frequency microwaves heating apparatus of the invention is easy, fast and energy-efficient, and a preferable heating condition can be obtained by selecting or combining heating methods based on the kind of food material and the cooking menu.

Preferably, the heating space 16 is closed to form a compartment by the oven plate 10 and walls of heating chamber 2 when the oven plate is placed in heating chamber 2 in order to stabilize high frequency microwave performance for heating food material by high frequency.

Figure 10:
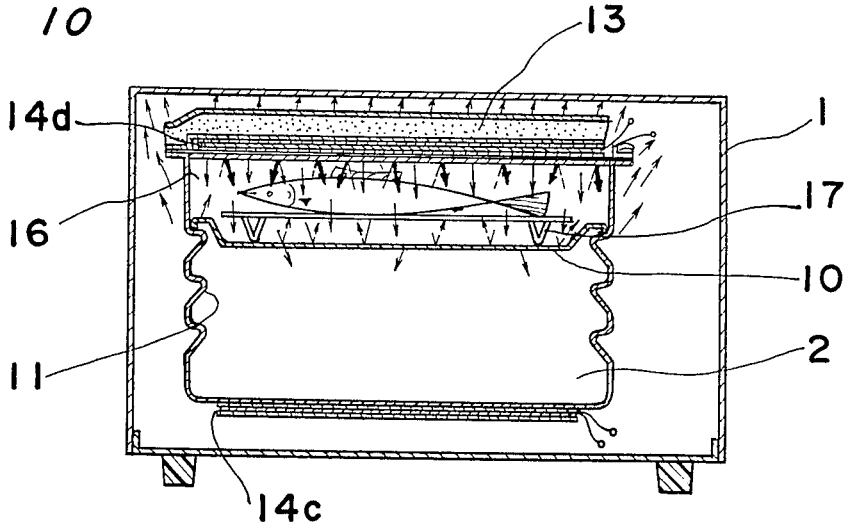
FIGS. 10 and 11 are cross-sectional view of a high frequency heating apparatus with an electric heating device in accordance with a third embodiment of the invention.

As shown in FIG. 10, the main body 1 is provided with the heating chamber 2 for accommodating food material and flat, plane heating elements 14*c* and 14*d* which serve as means for raising the atmospheric temperature of heating chamber 2. These flat heating elements are respectively mounted at the outside of and in contact with the bottom and the ceiling of heating chamber 2. The heat generated by these flat heating elements is adapted to raise the temperature in heating chamber 2 through its walls. In order to obtain a preferable heating condition depending on the type of heating method, food material is often placed on a lattice net 17 which is placed on the oven plate 10, which is held by rails 11 in a middle portion of heating chamber 2. The food material placed closely to the ceiling, is uniformly heated because the ceiling, which serves as a means for conducting heat to heating chamber 2, is heated in its entirety by the heating element. With this construction the oven plate 10 can be placed close to the ceiling so that it permits the food material to effectively absorb radiant heat energy generated from the ceiling, which is especially necessary in grill heating. Further, the temperature of heating space 16 greatly increases depending upon the heat conducted from the ceiling because the heating space is very small, and, thus, a preferable condition for grill heating is obtained in the heating chamber 2.

The heating condition when the flat heating element 14*d* is operated to heat is shown in FIG. 10. The main body 1 is provided with insulation material 13 for effectively conducting the heat generated by flat heating element 14*d*, the flat heating element 14*d* being surrounded by the insulation material 13 at its outside. The heat conduction in heating chamber 2 is shown by arrows in FIG. 10. Some of the heat irradiated from the ceiling directly strikes the food material, while the other thereof strikes the oven plate 10, not the food material and resulting in that the irradiant heat which has struck the oven plate 10 made of black enameled iron, is absorbed by and used to heat the oven plate 10, is wasted. As a result, the temperature of oven plate 10 rises extremely high due to the existence of the surface which has been given a black enamel treatment. Upon the rise of the temperature of the food material, the food material often drips and falls on the material supporting plate. As soon as the drips land on the plate, they will burn due to the temperature of the plate. And thus, thermal energy is increasingly wasted by evaporation heat used for this purpose. In order to prevent his, it is preferable to use an oven plate 10 which has an excellent heat reflection rate or whose surface is treated, or provided with material having an excellent heat reflection rate, and disposed between the food material and oven plate 10. As shown in FIG. 10, the radiant heat which has not irradiated the food material but strikes the oven plate 10 is all reflected by the oven plate 10 to be irradiated on and absorbed by the ceiling. Thus, radiant heat frequently moves up and down in heating chamber 2 through the oven plate 10, resulting in rising temperature of the ceiling. In addition, it is to be noted that radiant heat newly generated from the ceiling often multiplies the increase of the temperature in heating chamber 2, and the quantity of radiant heat also increases to a great extent. An application of a self-cleaning type of black enamel on the ceiling is adapted to increase the effective utilization of irradiated heat because such treatment on the ceiling is effective to make it excellent in absorbing and generating heat. Also, drips of heating food material on the oven plate 10 do not smoke and burn because the temperature of oven plate 10 thus formed is low. Therefore, the quantity of wasted heat is small, and the oven plate 10 and heating chamber walls are not soiled by smoke.

Figure 11:
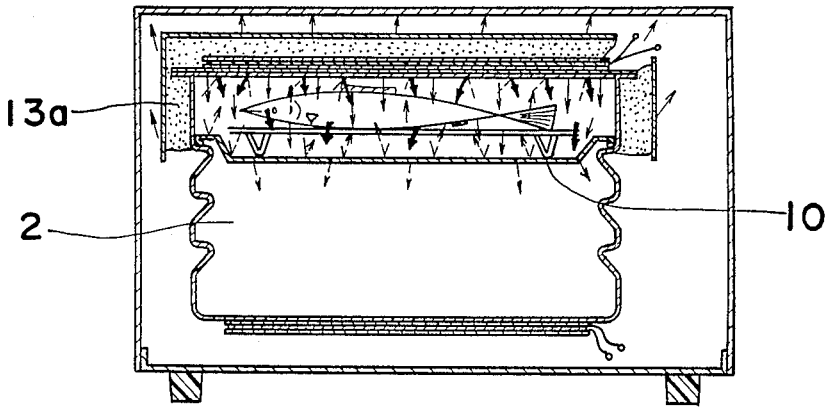

As shown in FIG. 11, providing insulation material 13*a* on all the heating chamber walls located above the oven plate 10 makes possible a fast and very effective heating condition even during grill heating which is normally performed with temperatures higher than oven heating because the provision of the insulation material reduces the heating space in which temperature has increased, the insulation material beign provided for preventing heat from escaping to the outside through the walls of heating chamber 2.

It is preferable to configure oven plate 10 and heating chamber 2 in a way that the heating space is completely divided by the oven plate 10.

When a conventional sheathed heater method is adapted for heating material food material on a surface-treated or heat-reflection oven plate, the radiant heat which is generated by heating element **5*b* and stricken oven plate 10, is not absorbed but reflected by oven plate 10. As a result, the temperature of oven plate 10 does not increase very much, and heating efficiency increases, yet, it is difficult for reflected radiant heat to be absorbed by heating element 5*b***. Therefore, in this case, the quantity of radiant heat energy does not increase.

Figure 12:
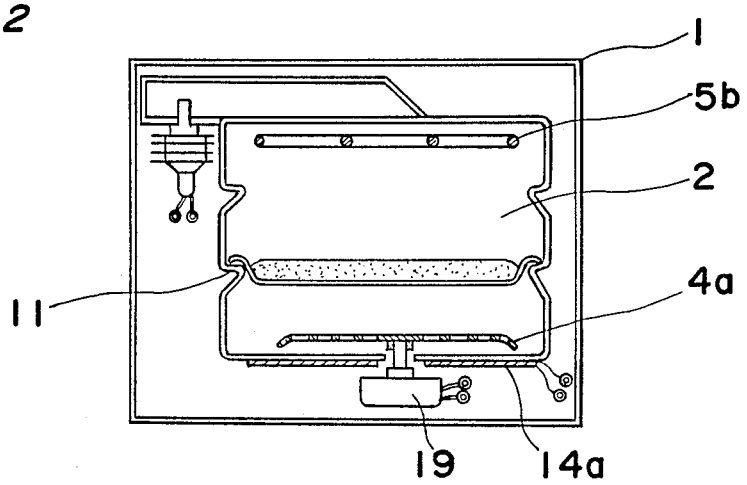
FIG. 12 is a cross-sectional view of a high frequency heating apparatus with an electric heating device in accordance with a fourth embodiment of the invention.
Figure 14:
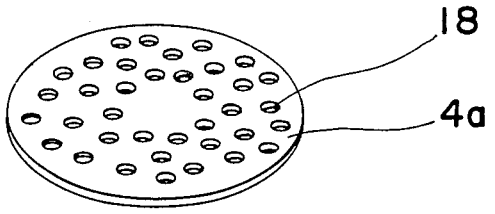
FIG. 14 is a perspective view of a turn table to be employed in the apparatus of the invention.
Figure 13:
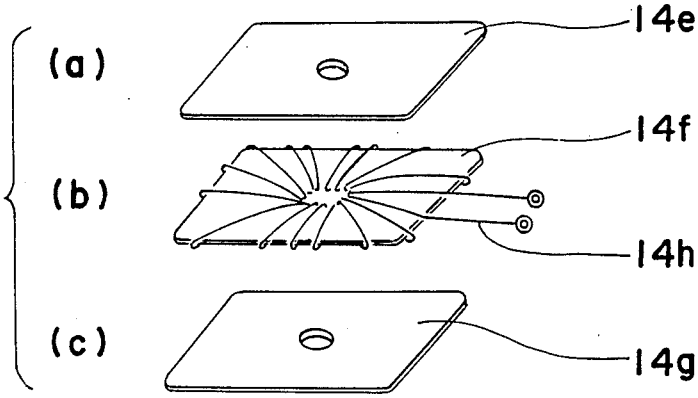
FIG. 13 is an exploded view of a flat heating element to be employed in the apparatus of the invention.

As shown in FIG. 12, the heating chamber 2 is provided with a sheathed heater **5*b* at the upper, inner portion thereof, and a flat heating element 14*a* at the outer portion of the bottom thereof. As shown in FIG. 13, the flat heating element 14*a* is composed of three insulation sheets 14*e*, 14*f*, and 14*g* each made of mica and heating wire 14*h*. As shown in FIG. 13, since heating wire 14*h* is wound such that it concentrates at the center portion of insulation sheet 14*f*, the temperature of the center portion becomes higher than the other portions of insulation sheet 14*f*. As shown in FIG. 14, the turn table 14*a* has many small perforations 18, thereby permitting the heat of the above-described flat heating element 14*a* to smoothly escape upward. The above-described perforations 18 of the turn table must not be disposed near the rotation axis of electric motor 19 in order to prevent it from being damaged. However, the perforations 18 in heating element 14*a*, which is heated at the center portion stronger than the other portions thereof, permits the food material to be uniformaly and flatly heated. The heat capacity of turn table 4*a* can be reduced because the turn table 4*a* has many perforations 18, thus, the the material is effectively heated in cooperation with the above-described smooth upward movement of radiant heat. Further, since flat heating element 14*a* is disposed on the outside of heating chamber 2, the above-described turn table 4*a* can be disposed close to the bottom of heating chamber 2. Therefore, the heating space in heating chamber 2 is increased and cleaning of the flat bottom of heating chamber 2 is easily performed by taking out the above-described turn table 4*a*. Various experiments indicated that the total area of perforations 18 of the above-described turn table 4*a* should be greater than 1/10 of the area of turn table 4*a*** so that the above-described heat efficiency can be improved and the food material is not non-uniformly heated.

Figure 15:
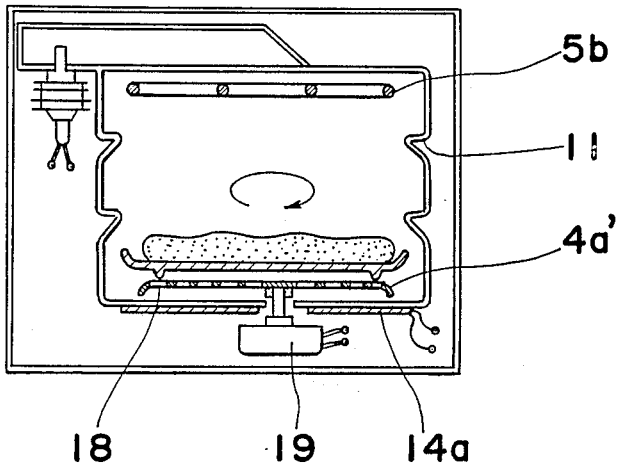
FIG. 15 is a cross-sectional view of the apparatus of the fourth embodiment during high frequency heating.

The method for heating material in this embodiment, by means of high frequency microwaves, will be described with reference to FIG. 15. Turn table **4*a* is rotated by electric motor 19 and the food material placed on turn table 4*a* is heated by high frequency microwaves. As described above, the diameter of perforations 18 on turn table 4*a* is so selected as not to pass high frequency electric power according to experiments, less than 30 mm, and the strength of electric field is uniform over the entire surface of turn table 4*a*. Further, the absence of a heater in heating chamber 2 permits mounting of a large turn table 4*a*′** on which a large article of food material can be placed.

As described above, according to the apparatus of the invention, the following advantages are obtained.

(1) Since oven heating and grill heating are performed by means of a flat heating element, i.e., no heater and projections such as an insulator for holding a heater are provided, when high frequency microwaves are supplied to a heating chamber with an oven plate placed in the heating chamber, abnormal heating such as local heating and sparks do not occur, and electric waves do not leak from seal means mounted on an outlet portion of the heating chamber. Accordingly, with the oven plate placed in the heating chamber, heating can be performed by means of high frequency microwaves and a heater which can be used alternately or in combination depending on situations to obtain the most preferable heating condition. Moreover, a fundamental and important heating method, i.e., heating of material by a heater after rapidly raising the bulk temperature of material by high frequency microwave heating is easily established. Because of this method, efficient heating, i.e., fast energy-efficient heating can be performed by a simple operation; namely, this method solves the problems where it takes a long time to heat when heating is performed by a heater and where a preferable heating condition cannot be obtained.

(2) Heating using a flat heating element permits food material to be heated uniformly because heat is irradiated from the flat heating element, and, accordingly, non-uniform heating of food material does not occur. Further, food material may be placed close to the flat heating element, thereby greatly decreasing heating time periods, and achieving fast energy-efficient heating.

(3) Since placing an oven plate in a heating chamber reduces heating space for the heater and food material and the heating space is effectively used for heating food material a rapid rising of the atmosphere temperature in the heating chamber can be easily accomplished when the food material is heated by a heater and energy is effectively used by a preferable heating condition.

Figure 16:
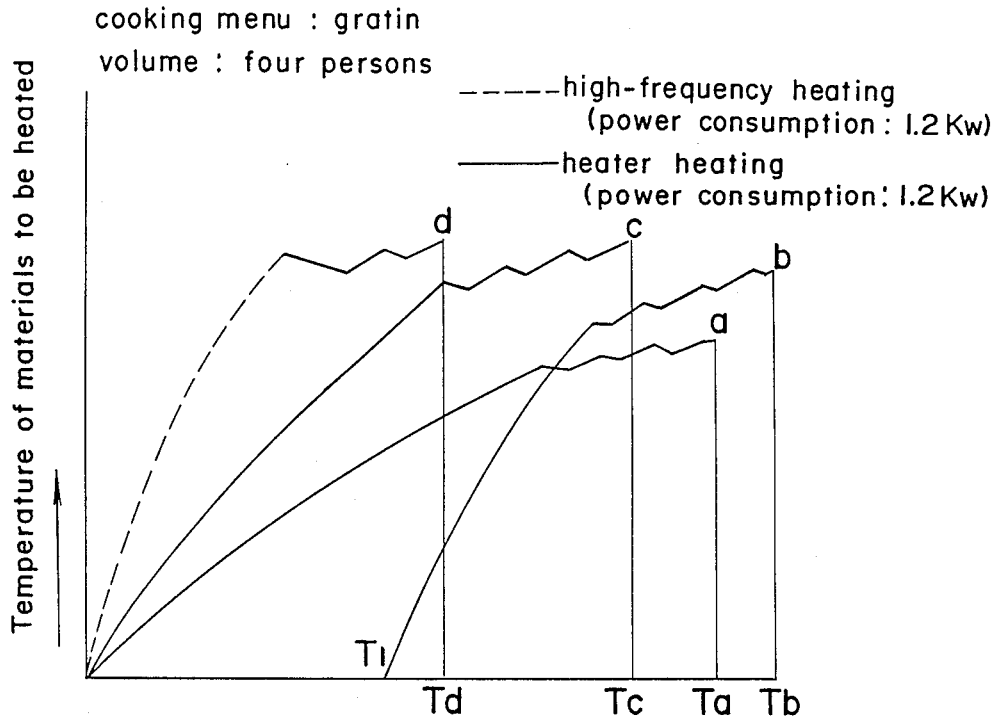
FIG. 16 is a schematic diagram showing the relationship between heating conditions and heating speed of a conventional apparatus and an apparatus of the invention.

The relationship between heating speed and heating condition is shown in FIG. 16.

(4) When high frequency heating is performed with the oven plate placed in the heating chamber, very non-uniform heating and impedance irregularities occur in a conventional apparatus. But, the provision of a bulge portion such as a diaphragm on the surfaces of the heating chamber walls prevents the lack of high frequency microwave output caused by non-uniform heating, impedance irregularities, and abnormal heating of a magnetron and moding, i.e., abnormal oscillation, thus greatly improving high frequency microwave response characteristics. That is, a bulge portion, provided in a heating chamber wall, opposite to a high frequency microwave supply opening has little influence on impedance when an ovne plate is not placed in the heating chamber, but the bulge portion greatly influnces impedance when the oven plate is placed in the heating chamber.

(5) Since the heating element on the heating chabmer ceiling is flat, food material is uniformly heated when the material is placed close to it. When the distance between the heating element and the food material is small, heat irradiated by the heating element which strikes the material is very effective for heating the material, hence, fast energy-efficient heating can be easily performed. Further, temperature rise time of the heating space is greatly reduced because the heating space is very small, thus preferable heating suitable for a grill heating is obtained.

(6) Since radiant heat generated by the flat heating element is reflected by the oven plate, the temperature of the oven plate does not easily rise, i.e., heat loss is very small. Further, drips which fall from the food material on the oven plate do not smoke, and thus, heat is not lost by varporization and further, the oven plate is not soiled because drips do not adhere to the oven plate. Accordingly, cleaning the oven plate after heating is easily performed.

In addition, the radiant heat reflected by the oven plate is absorbed by the flat heating element, which increases the quantity of radiant heat in cooperation with the radiant heat newly generated by the heating element, thus, improvement of heating efficiency is easily performed and a preferable heating condition suitable for a grill heating is obtained. An application of self-cleaning type of black enamel on the surface of the heating element further improves heating efficiency. Further, the enameled heating element produces effective insulation and temperature retention, thus, improving the above-described efficiency in grill heating.

(7) Since the heating chamber is provided with a heater at the bottom thereof and the metal turn table has many small diameter perforations, when food material is heated by a heater, non-uniform heating of food material does not occur and the heat generated by the heater disposed at the bottom of the heating chamber smoothly rises. Further, since the heat capacity of the turn table can be reduced, preferable heat efficiency is obtained. Moreover, this construction prevents heat from being trapped in the bottom of the heating chamber. Accordingly, electric parts, such as an electric motor do not fail. Further, heat is conducted uniformly to the turn table. Also, since the turn table is disposed directly above the heater disposed at the bottom of the heating chamber, the turn table may have a size such that the turn table covers the entire bottom of the heating chamber. Therefore, heat is effectively used and the apparatus is easy to handle.

Although the present invention has fully been described in connection with the preferred embodiments thereof, it is to be noted that various changes and modifications will be apparent to those skilled in the art. Accordingly, such changes and modifications are to be understood as included within the scope of the present invention as defined by the appended claims, unless they depart therefrom.

What is claimed is:

1. A heating apparatus for heating with radiant heat and microwaves, comprising:

a heating chamber for accommodating a food material to be heated, and having at least an upper wall of metal exposed to the interior of said chamber and having an oven plate holding means on the sidewalls of said heating chamber spaced downwardly from the upper wall;

a frequency oscillation device for generating microwaves and directing them toward said heating chamber;

a flat radiant heat supplying heating element against the outside of the metal upper wall of said heating chamber for supplying heat to the metal of said upper wall for raising the temperature of the entire area of the upper wall for causing radiant heat to be emitted from the metal upper wall at temperatures up to food grilling temperatures; and one chamber sidewall having a microwave supply opening therein between said holding means and said upper wall to which said frequency oscillation device supplies the microwaves into said heating chamber.

2. A heating apparatus as claimed in claim 1 in which the sidewall of said heating chamber opposite said microwave supply opening and above said oven plate holding means has an outwardly bulged portion for increasing the volume of the portion of the heating chamber above said oven plate holding means, whereby when an oven plate is placed on said holding means, it defines a smaller upper portion of the heating chamber in which the increased volume as compared to an upper portion without said bulged portion better accommodates the microwaves.

3. A heating apparatus as claimed in claim 1 in which the lower wall of said heating chamber is of metal exposed to the interior of said chamber, and a further flat radiant heat supplying element against the outside of the lower wall for supplying further radiant heat to the interior of said chamber.

4. A heating apparatus as claimed in claim 1 in which said plate is made of a material having a high rate of reflection of radiant heat.

5. A heating apparatus as claimed in claim 1 in which said plate has the upper surface of a material having a high rate of reflection of radiant heat.

6. A heating apparatus as claimed in claim 1 further comprising a layer of material having a high rate of reflection of radiant heat on the upper surface of said plate.

7. A heating apparatus as claimed in claim 1 in which the sidewalls and upper wall of said heating chamber above said holding means are insulated with heat insulating material.

8. A heating apparatus for heating with radiant heat and microwaves, comprising:

a heating chamber for accommodating a food material to be heated;

a frequency oscillation device for generating mcirowaves and directing them into said heating chamber;

a metal turntable in the bottom of said heating chamber and rotatable for rotating food material positioned thereon, said turntable having a plurality of perforations therein each having a dimension such that the microwaves cannot pass therethrough but which permit passage therethrough of radiant heat; and radiant heater means at the upper wall of said heating chamber, and radiant heater means at the lower wall of said heating chamber, said raidant heater means at the lower wall being a flat heater covering substantially the entire outer surface of the lower wall of the heating chamber, said lower wall being metal and transmitting the radiant heat from said radiant heater means therethrough into the interior of said heating chamber.

9. A heating apparatus as claimed in claim 8 in which said perforations cover greater than one-tenth the total surface area of said turntable.

* * * * *